US012084846B2

(12) United States Patent
Shiohara et al.

(10) Patent No.: US 12,084,846 B2
(45) Date of Patent: Sep. 10, 2024

(54) FLUSH TOILET

(71) Applicant: TOTO LTD., Kitakyushu (JP)

(72) Inventors: Eiji Shiohara, Fukuoka (JP); Yusuke Tone, Fukuoka (JP); Masaaki Momoe, Fukuoka (JP); Kazuya Esaki, Fukuoka (JP); Masaki Mori, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/586,824

(22) Filed: Jan. 28, 2022

(65) Prior Publication Data

US 2022/0316198 A1 Oct. 6, 2022

(30) Foreign Application Priority Data

Mar. 30, 2021 (JP) ..... 2021-057577

(51) Int. Cl.
*E03D 11/13* (2006.01)

(52) U.S. Cl.
CPC ..... *E03D 11/13* (2013.01)

(58) Field of Classification Search
CPC ..... E03D 11/13
USPC ..... 4/420
See application file for complete search history.

(56) References Cited

U.S. PATENT DOCUMENTS 2,508,305 A * 5/1950 Teetor ..... E05C 19/16 206/818
2,693,382 A * 11/1954 Teetor ..... E05C 19/16 292/251.5
5,190,325 A * 3/1993 Doss-Desouza ..... E05C 19/16 292/DIG. 60
7,278,175 B2 * 10/2007 Torres ..... A47K 3/161 4/584
2013/0117925 A1 * 5/2013 Torres ..... A47K 3/161 52/582.1

FOREIGN PATENT DOCUMENTS

| | | | |
|---|---|---|---|
| CN | 206015830 | | 3/2017 |
| CN | 206015830 U | * | 3/2017 |
| JP | 2007-262701 | | 10/2007 |
| JP | 2007262701 A | * | 10/2007 |
| JP | 2015-040409 | | 3/2015 |
| JP | 2020-165173 | | 10/2020 |

(Continued)

OTHER PUBLICATIONS

CN-206015830-U Machine Translation (Year: 2022).*

(Continued)

*Primary Examiner* — David P Angwin
*Assistant Examiner* — William R Klotz
(74) *Attorney, Agent, or Firm* — Amin, Turocy & Watson, LLP

(57) ABSTRACT

A flush toilet includes a toilet body that includes a bowl part that receives waste, a functional part that is provided on a back side of the toilet body, a panel member that covers a side surface of the functional part, a magnet that is provided on one of the panel member and the toilet body, a magnetic body that is provided on another of the panel member and the toilet body, and a holding part that holds one of the magnet and the magnetic body so as to be capable of being moved or deformed toward another of the magnet and the magnetic body.

4 Claims, 9 Drawing Sheets

(56) References Cited

FOREIGN PATENT DOCUMENTS

| | | | |
|---|---|---|---|
| KR | 10-2014-0067779 | | 6/2014 |
| KR | 20140067779 A | * | 6/2014 |

OTHER PUBLICATIONS

KR20140067779A Machine Translation (Year: 2022).*
JP-2007262701-A Machine Translation (Year: 2022).*
Japanese Decision to Grant a Patent for Japanese Patent Application No. 2021-057577 dated Jul. 12, 2022.

* cited by examiner

FLUSH TOILET

CROSS-REFERENCE TO RELATED APPLICATION(S)

The present application claims the benefit of priority to Japanese Patent Application No. 2021-057577 filed on Mar. 30, 2021, the entire contents of which Japanese Patent Application are incorporated by reference in the present application.

FIELD

A disclosed embodiment(s) relate(s) to a flush toilet.

BACKGROUND

For a flush toilet with a functional part that is covered by a panel member, a method has conventionally been known that uses magnetic force for holding the panel member on the flush toilet (see, for example, Japanese Patent Application Publication No. 2020-165173).

However, a panel member is composed of a resin material, so that generation of warpage and/or manufacturing variation may be generated. Thereby, for example, a space may be generated between a magnetic body of a toilet body and a magnet of a panel member. Furthermore, holding power that is provided by a magnetic body and a magnet has no tolerance for warpage, so that a panel member may detach from a toilet body. That is, a problem is that maintenance of a holding state of a panel member and a toilet body is difficult.

SUMMARY

A flush toilet according to an aspect of an embodiment includes a toilet body that includes a bowl part that receives waste, a functional part that is provided on a back side of the toilet body, a panel member that covers a side surface of the functional part, a magnet that is provided on one of the panel member and the toilet body, a magnetic body that is provided on another of the panel member and the toilet body, and a holding part that holds one of the magnet and the magnetic body to be capable of being moved or deformed toward another of the magnet and the magnetic body.

BRIEF DESCRIPTION OF DRAWING(S)

DESCRIPTION OF EMBODIMENT(S)

Figure 1:
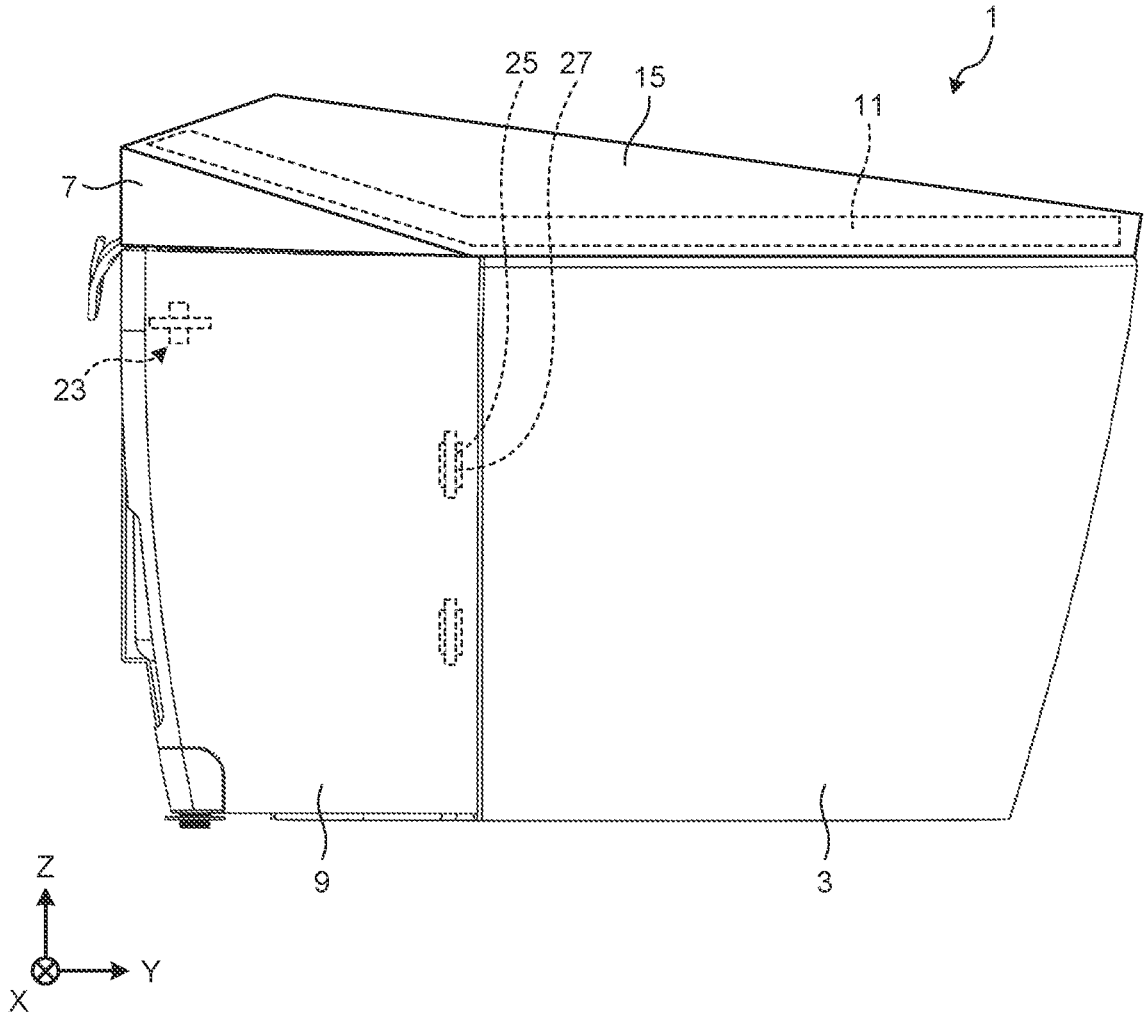
FIG. 1 is a side view of a flush toilet according to an embodiment.

Hereinafter, an outline of a flush toilet 1 according to an embodiment will be explained with reference to the accompanying drawing(s). FIG. 1 is a perspective view that illustrates the flush toilet 1 according to an embodiment.

Additionally, in respective figurers that include FIG. 1, a three-dimensional orthogonal coordinate system that includes a Z-axis where a vertically upward (an upward) direction is provided as a positive direction may be illustrated for explanatory convenience. In such a case, a positive direction of an X-axis, a negative direction of the X-axis, a positive direction of a Y-axis, a negative direction of the Y-axis, a positive direction of a Z-axis, and a negative direction of the Z-axis are defined as being leftward, rightward, frontward, backward, upward, and downward, and further, X-axis directions, Y-axis directions, and Z-axis directions are referred to as leftward and rightward directions, frontward and backward directions, and upward and downward directions. Additionally, leftward and rightward directions are width directions of the flush toilet 1.

Figure 2:
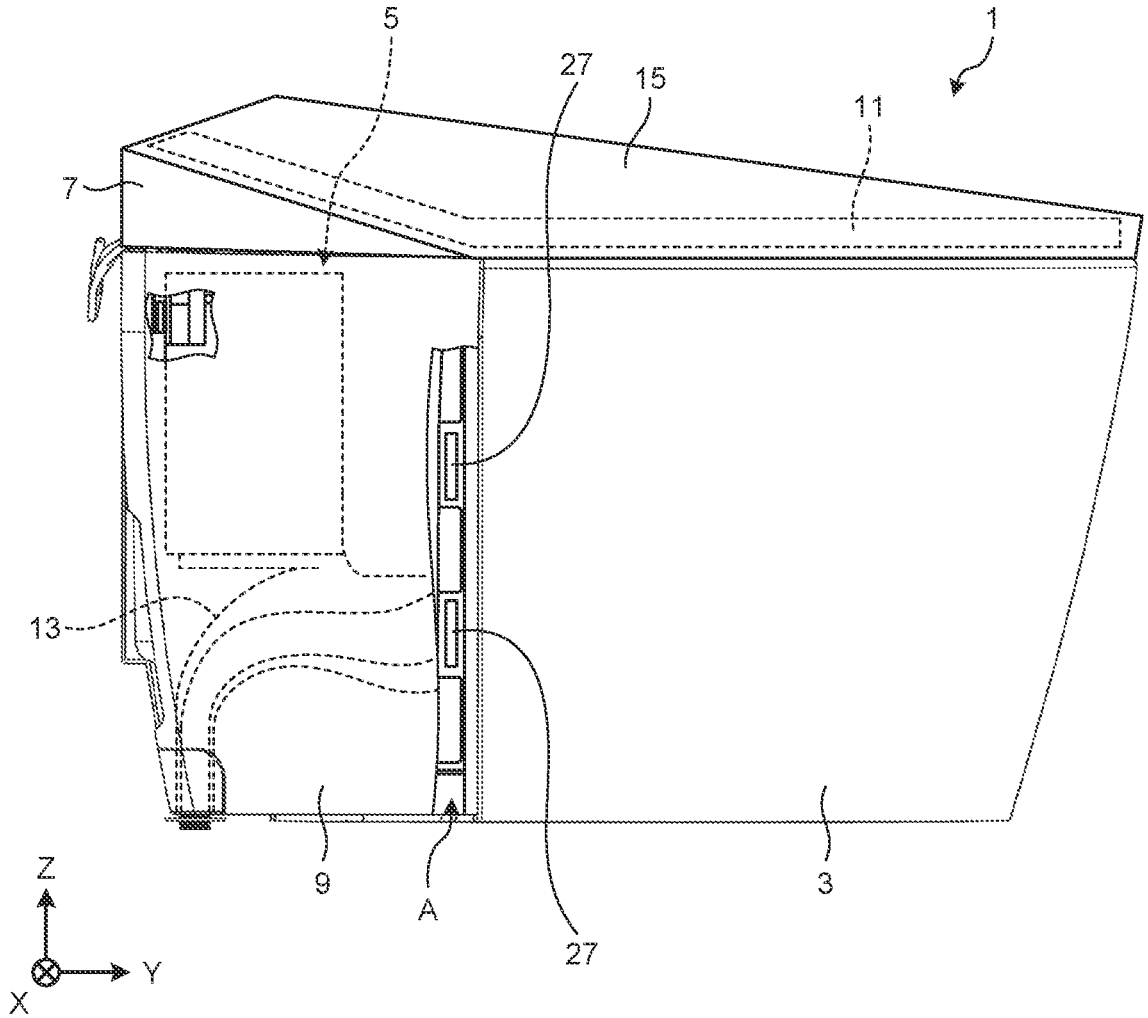
FIG. 2 is a side view where a part of a panel member and the like of a flush toilet according to an embodiment are omitted.

As illustrated in FIG. 1 and FIG. 2, the flush toilet 1 includes a toilet body 3, a functional part 5, a sanitary washing device 7, a panel member 9, and a toilet seat part 11. The toilet body 3 is made of a ceramic. Additionally, the toilet body 3 that is made of a ceramic is not limiting where, for example, it may be made of a resin or may be a combination of a ceramic and a resin. FIG. 1 is a side view of the flush toilet 1 according to an embodiment. FIG. 2 is a side view where a part of the panel member 9 and the like of the flush toilet 1 according to an embodiment are omitted.

The toilet body 3 has a bowl part (non-illustrated) and a drainage water trap pipeline 13.

The functional part 5 is provided on a back side of the toilet body 3. The functional part 5 executes water supply to a bowl part of the toilet body 3 and/or the sanitary washing device 7. The functional part 5 includes a water storage tank (non-illustrated), a pressurization pump (non-illustrated), and the like. In the functional part 5, for water supply, washing water that is stored in a water storage tank is pressurized by a pressurization pump, so that a high flow volume thereof is spouted from a jet water spout port (non-illustrated) to a bowl part.

The sanitary washing device 7 is provided with a private part washing device (non-illustrated) that includes a nozzle device (non-illustrated) that jets washing water toward a private part of a user on an upper side of a bowl part. Furthermore, the sanitary washing device 7 is provided with a water storage part (non-illustrated) that stores washing water that is supplied to a private part washing device, a heater (non-illustrated) that warms washing water in the water storage part to suitable temperature so as to provide warm water, a ventilation fan (non-illustrated), a deodorization fan (non-illustrated), a hot air fan (non-illustrated), a control part (non-illustrated) that controls each of these parts, and the like.

The panel member 9 for preventing an external obstacle on and/or sewage penetration to the functional part 5 is provided on a back side of the toilet body 3 and a side surface of the functional part 5. The panel member 9 is made of a resin.

The toilet seat part 11 is arranged on an upper part of the toilet body 3 and a user is seated thereon in a case where the flush toilet 1 is used thereby. The toilet seat part 11 is rotated around a back side thereof as a point of support so as to be capable of being opened and closed.

A lid part 15 is arranged on an upper part of the toilet body 3 similarly to the toilet seat part 11 and covers an upper surface of the toilet body 3 that includes a bowl part thereof from an upper side thereof. The lid part 15 is rotated around a back side thereof as a point of support so as to be capable of being opened and closed, similarly to the toilet seat part 11. Additionally, the lid part 15 in a closed state thereof covers an upper surface of the toilet body 3 from an upper side thereof and covers the toilet seat part 11 from an upper side thereof.

A bowl part is a site that receives waste and is formed into a recess shape. A rim part (non-illustrated) is formed on an upper edge part of a bowl part. A rim part has a rim water spout port (non-illustrated) that spouts washing water. Washing water that is spouted from a rim water spout port of a rim part flows along an upper edge part of a bowl part so as to form a swirling flow in the bowl part. Additionally, a water conduit (non-illustrated) that is formed on an upstream side is connected to a rim water spout port and washing water from a washing water supply device (non-illustrated) is supplied through the water conduit.

Figure 3:
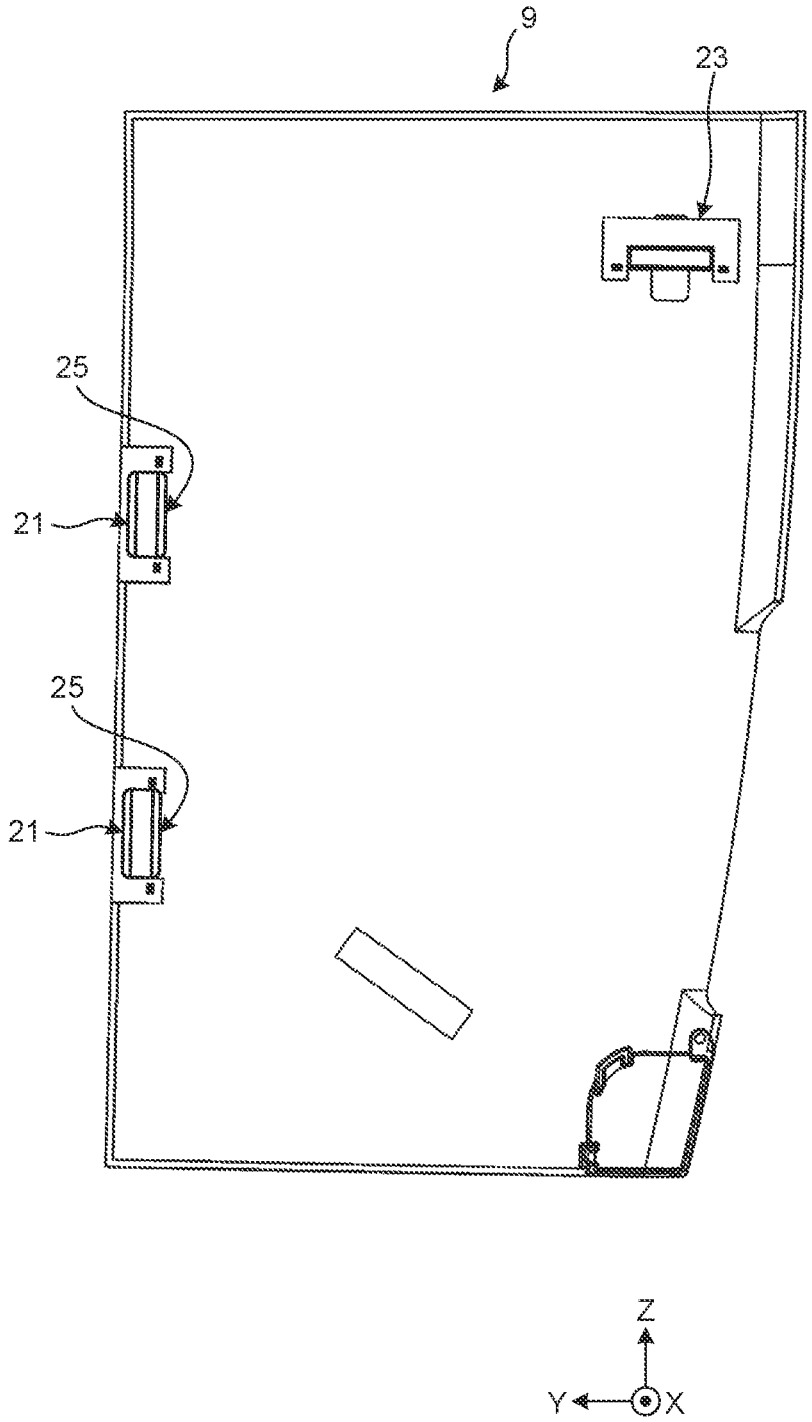
FIG. 3 is a diagram where a side of a panel member according to an embodiment is viewed from an inside thereof.

Next, attachment of a panel member 9 to a toilet body 3 will be explained with reference to FIG. 1 to FIG. 3. FIG. 3 is a diagram where a side of the panel member 9 according to an embodiment is viewed from an inside thereof.

A flush toilet 1 includes a first adsorption part 21 and a second adsorption part 23. The first adsorption part 21 adsorbs and holds a side surface of the panel member 9 and the toilet body 3 by magnetic force and the second adsorption part 23 adsorbs and holds a functional part 5 and a side surface of the panel member 9 by magnetic force.

The first adsorption part 21 will be explained in detail. The first adsorption part 21 is composed of a magnet 25 and a metal plate 27 that is a magnetic body that is adsorbed by magnetic force thereof. The first adsorption part 21 is provided on a boundary part A between the toilet body 3 and the panel member 9. The boundary part A refers to a place where, when the panel member 9 is properly placed on the toilet body 3, the panel member 9 overlaps with the toilet body 3. The boundary part A refers to a place where, when a side of the toilet body 3 is viewed, a side surface of the toilet body 3 that is changed at a gentle curvature from a front side thereof has a great curvature change on a back side of the toilet body 3, in detail, a place that has a step that is dented toward an inside of the toilet body 3.

The magnet 25 is attached to the panel member 9. The magnet 25 is provided at two places on a side of a front end of an inner side surface of the panel member 9, that is, near a boundary between the toilet body 3 and the panel member 9. Two places for arrangement of the magnet 25 are one place in an interval between an upper end and a center of the panel member 9 and one place in an interval between a lower end and the center of the panel member 9.

Figure 4:
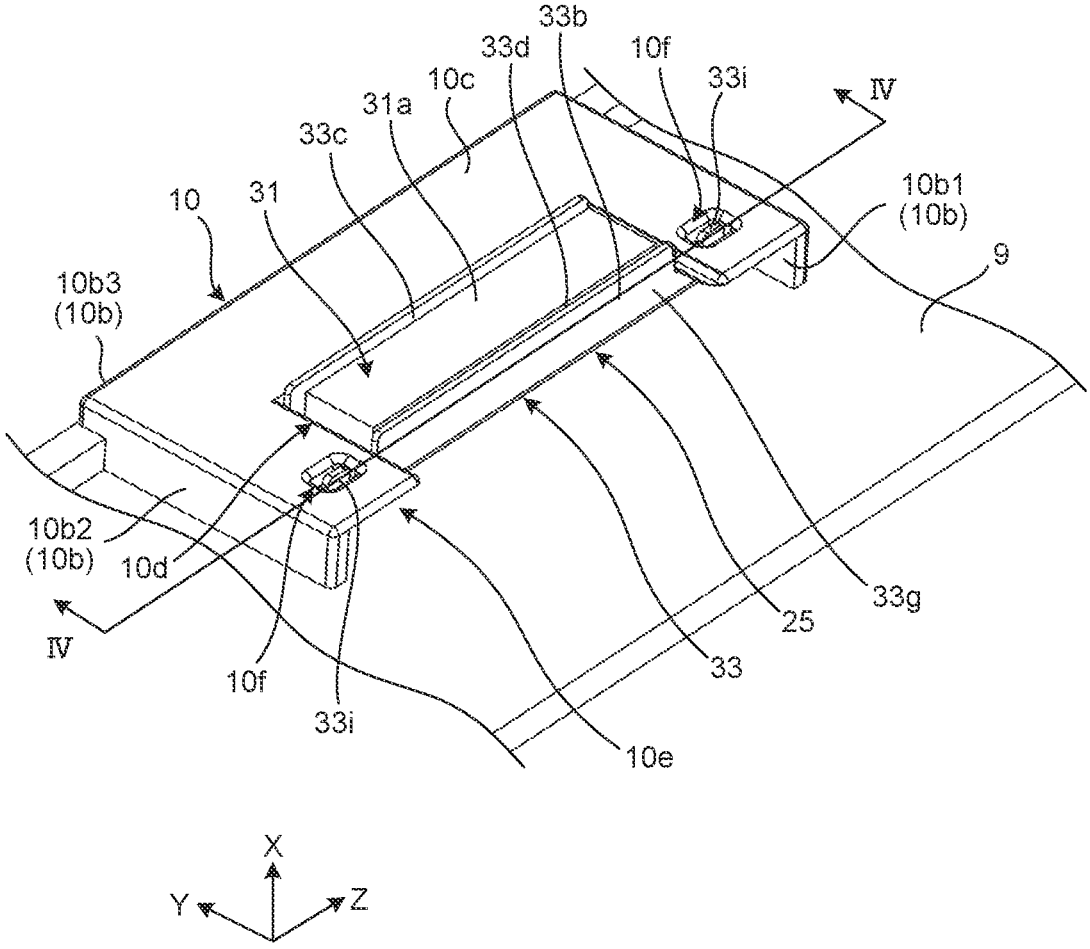
FIG. 4 is a perspective view of a state where a magnet that has a yoke according to an embodiment is held by a holding part.
Figure 5:
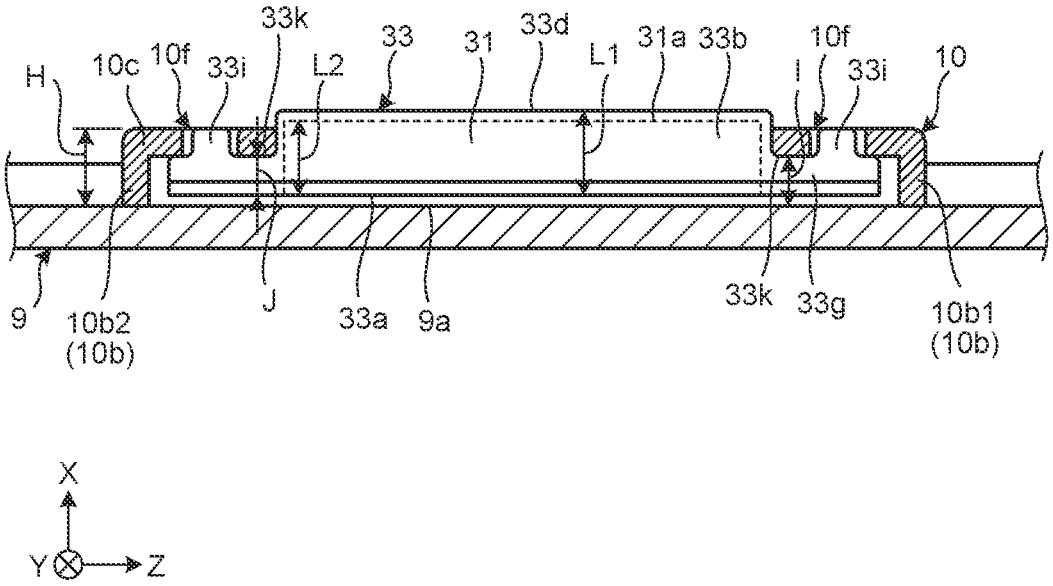
FIG. 5 is a schematic diagram of a state where a magnet that has a yoke according to an embodiment is held by a holding part, in a IV-IV cross-sectional view that is illustrated in FIG. 4.
Figure 6:
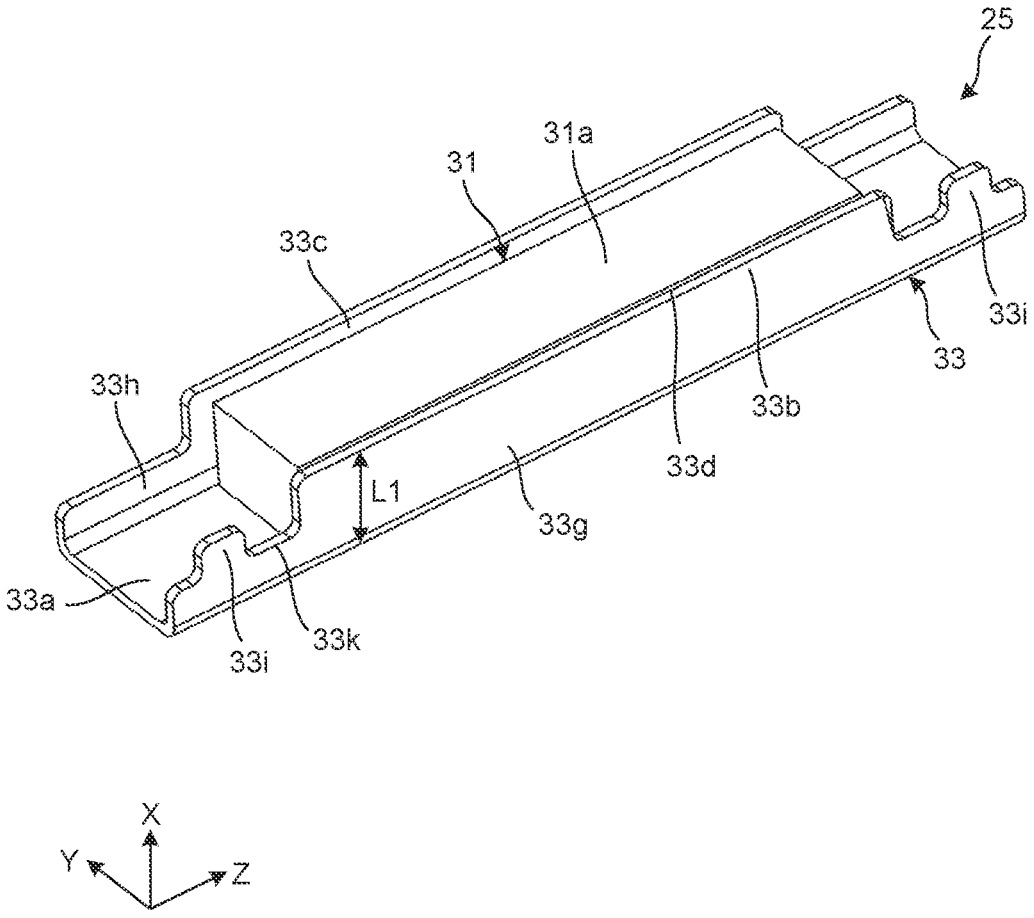
FIG. 6 is a perspective view of a magnet that has a yoke according to an embodiment.
Figure 7:
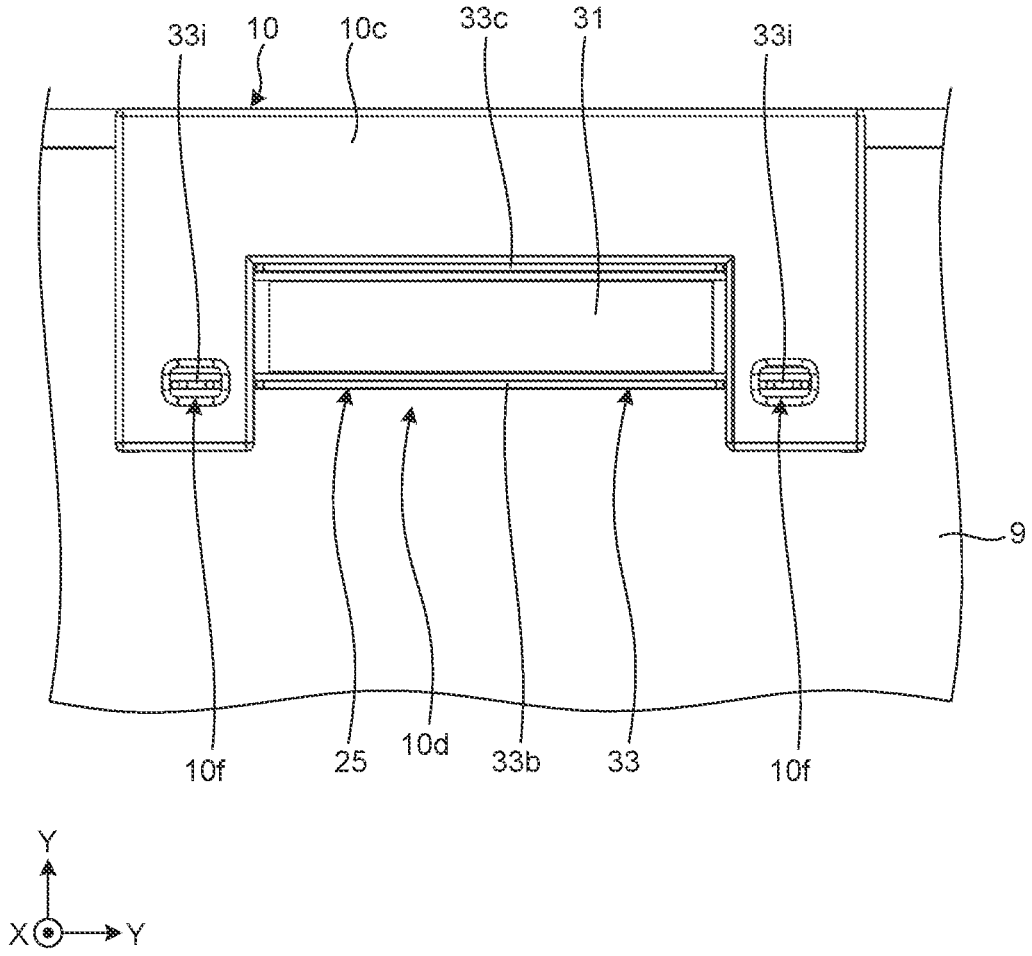
FIG. 7 is a side view of a state where a magnet that has a yoke according to an embodiment is held by a holding part, as viewed from an inside of a panel member.

Next, a magnet 25 of a first adsorption part 21 will be explained with reference to FIG. 4 to FIG. 7. FIG. 4 is a perspective view of a state where the magnet 25 that has a yoke 33 according to an embodiment is held by a holding part 10. FIG. 5 is a schematic diagram of a IV-IV cross-sectional view that is illustrated in FIG. 4 in a state where the magnet 25 that has the yoke 33 according to an embodiment is held by the holding part 10. FIG. 6 is a perspective view of the magnet 25 that has the yoke 33 according to an embodiment. FIG. 7 is a side view that is viewed from an inside of a panel member 9 in a state where the magnet 25 that has the yoke 33 according to an embodiment is held by the holding part 10.

The magnet 25 includes a magnet body 31 and a yoke 33. A shape of the magnet body 31 is a cuboid with a small thickness. The magnet 25 is attached to the holding part 10 of the panel member 9 by the yoke 33. The magnet body 31 is attached to the yoke 33. The magnet body 31 is bonded to the yoke 33.

The yoke 33 includes a bottom surface 33*a* with a rectangular shape, a first side surface 33*g* that extends from a back side of the bottom surface 33*a*, and a second side surface 33*h* that extends from a front side of the bottom surface 33*a*. A first protrusion wall 33*b* that extends in leftward and rightward directions is formed on the first side surface 33*g* and a second protrusion wall 33*c* that extends in leftward and rightward directions is formed on the second side surface 33*h*. A third protrusion wall 33*i* is formed on the first side surface 33*g* at each one of places above and below relative to the first protrusion wall 33*b*. The first side surface 33*g* between the first protrusion wall 33*b* and the third protrusion wall 33*i* is called a recessed part 33*k*.

Furthermore, a length from the bottom surface 33*a* to a tip of the first protrusion wall 33*b* is greater than a thickness of the magnet body 31 in leftward and rightward directions, a length of the bottom surface 33*a* in upward and downward directions is greater than a length of the magnet body 31 in upward and downward directions, and a length of the bottom surface 33*a* in frontward and backward directions is greater than a length of the magnet body 31 in frontward and backward directions. The magnet body 31 is arranged on the bottom surface 33*a* and is formed so as to be put between the first side surface 33*g* and the second side surface 33*h*.

The panel member 9 includes the holding part 10 for enclosing the magnet 25. The holding part 10 has a wall part 10*b* that covers a part of an upper surface, a lower surface, and a front surface of the magnet 25. The wall part 10*b* includes an upper surface 10*b*1 that extends perpendicularly from the panel member 9, a lower surface 10*b*2 that extends perpendicularly from the panel member 9 similarly, and a front surface 10*b*3 that extends perpendicularly from the panel member 9 similarly and connects the upper surface 10*b*1 and the lower surface 10*b*2.

Furthermore, the panel member 9 is provided with a supporting surface 10*c* so as to connect a tip of the wall part 10*b* thereto. An attachment hole 10*f* and a cut part 10*d* are formed on the supporting surface 10*c*. An opening part 10*e* is provided at back end of the holding part 10.

The third protrusion wall 33*i* of the yoke 33 is inserted into the attachment hole 10*f*. A length of the attachment hole 10*f* in upward and downward directions is greater than a length of the third protrusion wall 33*i* in upward and downward directions and a length of the attachment hole 10*f* in frontward and backward directions is greater than a length of the third protrusion wall 33*i* in frontward and backward directions. When the magnet 25 is attached to the holding part 10, the attachment hole 10*f* and the third protrusion wall 33*i* have gaps in upward and downward directions and frontward and backward directions.

An added length L1 of the first side surface 33*g* and the first protrusion wall 33*b* of the yoke 33 and a thickness L2 of the magnet body 31 in leftward and rightward directions are greater than a length H from a panel member surface 9*a* to an upper surface of the supporting surface 10*c*, so that, when the magnet body 31 and the yoke 33 are attached to the holding part 10, a tip part 33*d* of the yoke 33 in leftward and rightward directions and a tip part 31*a* of the magnet body 31 in leftward and rightward directions protrude relative to the supporting surface 10*c*. That is, the tip part 31*a* of the magnet body 31 and the tip part 33*d* of the yoke 33 are protrusion parts that protrude from the supporting surface 10*c* toward a side of a metal plate 27.

The magnet 25 is inserted from the opening part 10*e* that is formed on the holding part 10 into the holding part 10. The third protrusion wall 33*i* of the yoke 33 is inserted into the attachment hole 10*f* of the supporting surface 10*c*, so that movement of the magnet 25 in a direction that intersects with leftward and rightward directions, for example, frontward and backward directions and upward and downward directions, relative to the panel member 9 is restricted. Additionally, a gap is provided between the second protrusion wall 33*c* and a wall that forms the attachment hole 10*f*, so that it is possible to move along an intersecting direction by the gap. Thereby, it is possible for the magnet 25 to move not only in leftward and rightward directions but also in intersecting directions, so that it is possible to suppress detachment of the panel member 9 and the toilet body 3 and maintain a holding state of the panel member 9 and the toilet body 3.

Movement of the magnet 25 that is arranged in the holding part 10 will be explained. A length J from the bottom surface 33*a* of the yoke 33 to the recessed part 33*k* thereof is less than a length I from the panel member surface 9*a* to a lower surface of the supporting surface 10*c* and a gap is provided therebetween, so that the magnet 25 is capable of being moved by such a gap. However, as the magnet 25 is moved, the recessed part 33*k* contacts the supporting surface 10*c*, so that such movement is restricted.

Then, the metal plate 27 will be explained. The metal plate 27 is attached to the toilet body 3. The metal plate 27 is attached to a side surface of the toilet body 3 at a boundary part A. The metal plate 27 is provided at two places at the boundary part A of the toilet body 3. Two places for arrangement of the metal plate 27 are one place in an interval between an upper end and a center of the boundary part A and one place in an interval between a lower end and the center of the boundary part A. In a case where the panel member 9 is attached thereto at a proper position, the metal plate 27 is arranged so as to face the magnet 25. In the toilet body 3, a place where the metal plate 27 is placed is dented inward and a part of the metal plate 27 is embedded in such a dented place, so that the metal plate 27 is fixed thereon. The metal plate 27 may be bonded to the toilet body 3.

A shape of the metal plate 27 is a cuboid with a small thickness. The metal plate 27 is provided in such a manner that a short side of the metal plate 27 is provided along frontward and backward directions. That is, the metal plate 27 is arranged in such a manner that a length thereof in upward and downward directions is greater than a length thereof in frontward and backward directions. When a side of the toilet body 3 is viewed, a length of the metal plate 27 in frontward and backward directions is less than or equal to a length of the boundary part A in frontward and backward directions. Additionally, the metal plate 27 may be provided with a structure like a single plate that is elongated upward and downward.

Then, movement of the magnet 25 that is adsorbed on the metal plate 27 at a time when the panel member 9 is attached to the toilet body 3 will be explained. As the magnet 25 is moved close to the metal plate 27, the magnet body 31 and the yoke 33 that is foxed on the magnet body 31 move to a side of the metal plate 27 by magnetic force that acts between the metal plate 27 and the magnet body 31 until the recessed part 33*k* contacts the supporting surface 10*c* toward the metal plate 27. Herein, the tip part 31*a* of the magnet body 31 and the tip part 33*d* of the yoke 33 are moved close to the metal plate 27 relative to the supporting surface 10*c*. The panel member 9 is made of a resin, so that warpage and/or manufacturing variation may be generated and a proper position of the panel member 9 relative to the toilet body 3 may be shifted in leftward and rightward directions. As such a shift is caused, a problem occurs in such a manner that it is not possible for the magnet 25 of the panel member 9 to contact the metal plate 27 of the toilet body 3. In a configuration of an embodiment, the recessed part 33*k* is capable of moving toward the metal plate 27 until it contacts the supporting surface 10*c*, so that it is possible to decrease a distance between the magnet 25 and the metal plate 27 so as to improve adsorption force and it is possible to prevent the magnet body 31 from dropping toward a side of the metal plate 27 by the holding part 10, that is, to suppress detachment between the panel member 9 and the toilet body 3 so as to maintain a holding state of the panel member 9 and the toilet body 3.

Furthermore, even in a case where the magnet 25 is moved close to the metal plate 27 in a state where it is not provided on a vertical line, it is possible for the magnet body 31 and the yoke 33 to move in upward and downward directions and frontward and backward directions until the second protrusion wall 33*c* contacts a wall that forms the attachment hole 10*f*, so that the magnet body 31 and the yoke 33 move so as to follow the metal plate 27. In such a configuration, it is possible to decrease a distance between the magnet body 31 and the metal plate 27 regardless of a direction(s) of warpage and/or manufacturing variation of the panel member 9, so that it is possible to suppress detaching of the panel member 9 from the toilet body 3.

A place that contacts the metal plate 27 in the magnet 25 is not the magnet body 31 but is the yoke 33. In such a configuration, even if the magnet 25 and the metal plate 27 repeat joining and separation thereof many times, a surface shape and/or a surface contamination of the magnet body 31 is/are not greatly changed by the yoke 33. Hence, it is possible to prevent a change of adsorption force between the panel member 9 and the toilet body 3 that is caused by a secular change(s) thereof. Additionally, the magnet body 31 in the magnet 25 may contact the metal plate 27.

A basic configuration of a second adsorption part 23 is identical to that of the first adsorption part 21. However, a direction of an opening part thereof is a downward direction, differently from the first adsorption part 21. Additionally, a magnet body (non-illustrated) for the second adsorption part 23 may be bonded to the panel member 9 so as to provide an immobile configuration.

Figure 8:
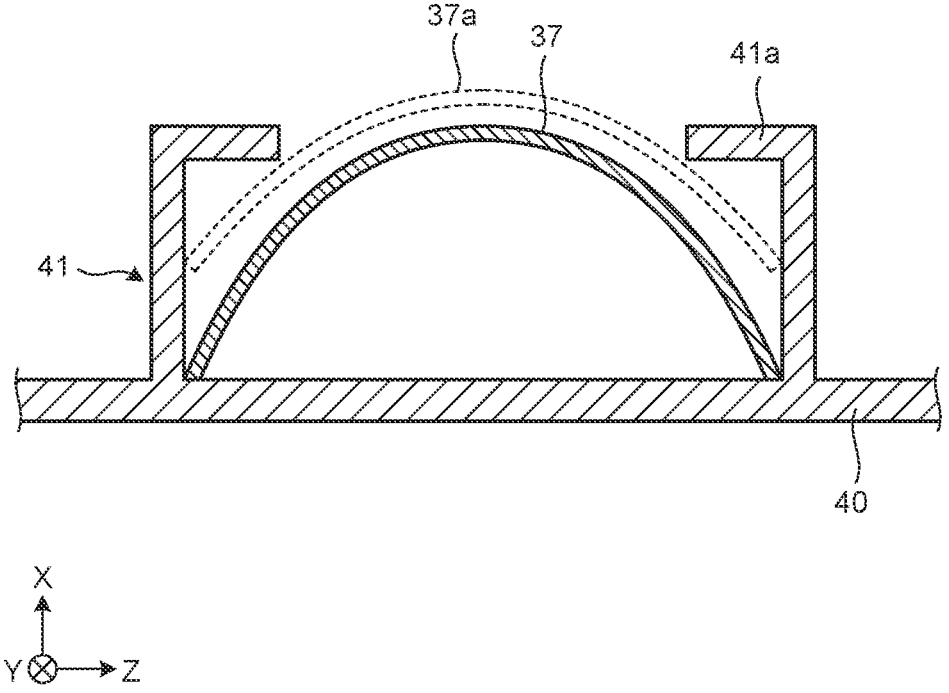
FIG. 8 is an operation diagram at a time when a magnet is moved close to a metal plate that is provided on a panel member according to a variation.

As illustrated in FIG. 8, in a flush toilet 1 according to a variation, a metal plate 37 may be provided on a panel member 40. FIG. 8 is an operation diagram at a time when a magnet (non-illustrated) is moved close to the metal plate 37 that is provided on the panel member 40 according to a variation. In the flush toilet 1 according to a variation, a magnet is provided on a toilet body (non-illustrated). For example, a magnet is bonded to a toilet body. The metal plate 37 is a cuboid with a small thickness in leftward and rightward directions and has a tip part 37*a* that protrudes toward a toilet body. The metal plate 37 with a curved shape is arranged on a holding part 41.

Movement of the metal plate 37 that is arranged in the holding part 41 will be explained. For the metal plate 37, magnetic force acts between a magnet and the metal plate 37, so that the metal plate 37 is capable of moving toward a toilet body in the holding part 41. However, as the metal plate 37 is moved, it contacts a supporting surface 41*a*, so that such movement is restricted. Furthermore, the metal plate 37 collides with the supporting surface 41*a* and a curvature of the tip part 37*a* is decreased, so that it is possible to increase an amount of protrusion of the metal plate 37 from the supporting surface 41*a*. Furthermore, the metal plate 37 may contact the supporting surface 41*a* from a state where magnetic force does not act thereon. Thereby, it is possible to decrease a surface area of a place where the metal plate 37 protrudes therefrom, so that it is possible to prevent the metal plate 37 from dropping toward a side of a magnet and decrease a distance between the metal plate 37 and the magnet, and hence, it is possible to improve an adsorption force.

Figure 9:
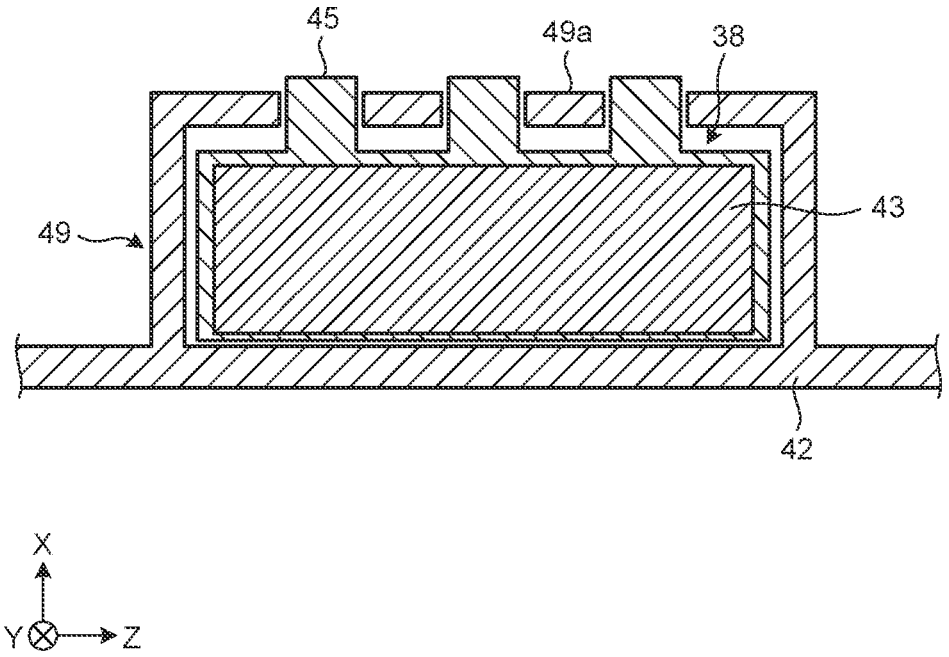
FIG. 9 is a schematic diagram of a state where a magnet that has a protection part according to a variation is held by a holding part.

As illustrated in FIG. 9, a flush toilet 1 according to another variation includes a magnet 38 that has a protection part 45 that is a non-magnetic body around a magnet body 43. FIG. 9 is a schematic diagram of a state where the magnet 38 that has the protection part 45 according to a variation is held by a holding part 49. The protection part 45 protrudes toward a side of a toilet body (non-illustrated) relative to a holding surface 49*a* of the holding part 49 in a state where magnetic force does not act thereon. The protection part 45 transmits magnetic force, so that, for fixation of a toilet body and a panel member 42, the fixation is executed in a state where a metal plate (non-illustrated) contacts the protection part 45. That is, the present configuration is a configuration where not the magnet body 43 but the protection part 45 contacts a metal plate, so that, even if the magnet 38 and a metal plate repeat joining and separation thereof many times, for example, a surface shape and/or a surface contamination of a magnet is/are not greatly changed by the protection part 45. Hence, it is possible to prevent a change of adsorption force between the panel member 42 and a toilet body that is caused by a secular change(s) thereof.

An aspect of the present embodiment aims to maintain a holding state of a panel member and a toilet body in a case where warpage and/or manufacturing variation is/are generated in the panel member.

A flush toilet according to an aspect of an embodiment is characterized by including a toilet body that has a bowl part that receives waste, a functional part that is provided on a back side of the toilet body, a panel member that covers a side surface of the functional part, a magnet that is provided on one of the panel member and the toilet body, a magnetic body that is provided on another of the panel member and the toilet body, and a holding part that holds one of the magnet and the magnetic body to be capable of being moved or deformed toward another of the magnet and the magnetic body.

In such a configuration, even if warpage and/or manufacturing variation is/are generated in a panel member, it is possible to decrease a distance between one and another of a magnet and a magnetic body. Furthermore, it is possible to suppress detaching of a panel member from a toilet body. Hence, it is possible to improve adsorption force of a panel member and a toilet body, so that it is possible to maintain a holding state of the panel member and the toilet body.

Furthermore, it is characterized in that the holding part has a supporting surface that suppresses moving or deforming of one of the magnet and the magnetic body toward another of the magnet and the magnetic body, and a part of one of the magnet and the magnetic body is capable of being moved or deformed toward another of the magnet and the magnetic body relative to the supporting surface.

In such a configuration, it is possible to prevent one of a magnet and a magnetic body from dropping toward a side of another of the magnet and the magnetic body, by a holding part. Furthermore, it is possible to decrease a distance between one and another of a magnet and a magnetic body. Hence, it is possible to improve adsorption force.

Furthermore, it is characterized in that one of the magnet and the magnetic body includes a protrusion part that protrudes toward a side of another of the magnet and the magnetic body relative to the supporting surface.

In such a configuration, for example, in a case where one of a magnet and a magnetic body moves toward a side of another of the magnet and the magnetic body, one of a magnet and a magnetic body where a protrusion part thereof protrudes contacts a supporting surface, so that it is possible to prevent dropping thereof toward a side of another of the magnet and the magnetic body. Furthermore, it is possible to decrease a distance between one and another of a magnet and a magnetic body, by such a protrusion part. Hence, it is possible to improve adsorption force.

Furthermore, it is characterized in that the holding part holds one of the magnet and the magnetic body to be capable of being moved or deformed in a direction that intersects with a direction toward the magnet or the magnetic body.

In such a configuration, it is possible to decrease a distance between one and another of a magnet and a magnetic body, regardless of a direction(s) of warpage and/or manufacturing variation of a panel member. Furthermore, it is possible to suppress detaching of a panel member from a toilet body.

Furthermore, it is characterized by including a protection part that is provided on one of the magnet and the magnetic body, contacts another of the magnet and the magnetic body, and is a non-magnetic body.

In such a configuration, even if a magnet and a magnetic body repeat joining and separating thereof many times, for example, a surface shape and/or a surface contamination of a magnet is/are not greatly changed by a protection part. Hence, it is possible to prevent a change of adsorption force of a panel member and a toilet body that is caused by a secular change(s) thereof.

In a flush toilet according to the present embodiment, it is possible to maintain a holding state of a panel member and a toilet body even in a case where warpage and/or manufacturing variation is/are generated in the panel member.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet, comprising:

a toilet body that includes a bowl part that receives waste;

a functional part that is provided on a back side of the toilet body;

a panel member that covers a side surface of the functional part;

a magnet that is provided on one of the panel member and the toilet body;

a magnetic body that is provided on another of the panel member and the toilet body; and a holding part that holds one of the magnet and the magnetic body in such a manner that the one of the magnet and the magnetic body is moved toward another of the magnet and the magnetic body relative to the holding part, wherein the holding part includes a supporting surface that is capable of contacting the one of the magnet and the magnetic body to suppress moving of the one of the magnet and the magnetic body toward the another of the magnet and the magnetic body, and a tip part of the one of the magnet and the magnetic body is moved toward the another of the magnet and the magnetic body relative to the supporting surface in a state where the tip part of the one of the magnet and the magnetic body is parallel to the supporting surface, wherein the one of the magnet and the magnetic body includes a protrusion part that protrudes toward a side of the another of the magnet and the magnetic body relative to the supporting surface, at least on a central part of the one of the magnet and the magnetic body in a longitudinal direction of the one of the magnet and the magnetic body, wherein the holding part holds the one of the magnet and the magnetic body in such a manner that the one of the magnet and the magnetic body is moved in a direction that intersects with a direction toward the another of the magnet or the magnetic body.

2. The flush toilet according to claim 1, wherein the supporting surface covers at least areas of the one of the magnet and the magnetic body outside the protrusion part in the longitudinal direction of the one of the magnet and the magnetic body.

3. The flush toilet according to claim 1, further comprising:

a protection part that is provided on the one of the magnet and the magnetic body, contacts the another of the magnet and the magnetic body, and is a non-magnetic body.

4. The flush toilet according to claim 1, wherein:

the one of the magnet and the magnetic body is the magnet; and the another of the magnet and the magnetic body is the magnetic body.

* * * * *